United States Patent [19]

Grise et al.

[11] Patent Number: 4,485,297

[45] Date of Patent: Nov. 27, 1984

[54] ELECTRICAL RESISTANCE HEATER

[75] Inventors: Frederick G. J. Grise, Osterville, Mass.; William C. Stumphauzer, Elyria, Ohio

[73] Assignee: Flexwatt Corporation, Wellesley, Mass.

[21] Appl. No.: 295,000

[22] Filed: Aug. 21, 1981

Related U.S. Application Data

[63] Continuation-in-part of Ser. No. 181,974, Aug. 28, 1980, abandoned.

[51] Int. Cl.[3] ..... H05B 3/34

[52] U.S. Cl. ..... 219/528; 174/68.5; 219/345; 219/541; 219/543; 219/549; 338/212; 338/295; 338/314; 338/320; 338/330

[58] Field of Search ..... 219/203, 301, 345, 522, 219/528, 529, 541, 543, 544, 548, 549, 552, 553; 338/217, 211, 212, 293, 300, 309, 319, 320, 330; 174/68.5

[56] References Cited

U.S. PATENT DOCUMENTS

| | | | |
|---|---|---|---|
| 1,015,991 | 1/1912 | Clark | 338/212 |
| 1,384,467 | 7/1921 | Homan | 219/528 X |
| 1,985,166 | 12/1934 | Haroldson | 338/217 X |
| 2,282,832 | 5/1942 | Spooner | 252/510 |
| 2,473,183 | 6/1949 | Watson | 219/543 |
| 2,489,643 | 11/1949 | Hunter | 219/528 X |
| 2,503,457 | 4/1950 | Speir et al. | 219/528 |
| 2,557,983 | 6/1951 | Linder | 219/543 |
| 2,559,077 | 7/1951 | Johnson et al. | 219/543 |
| 2,575,987 | 11/1951 | York et al. | 219/528 |
| 2,641,675 | 6/1953 | Hannahs | 174/68.5 |
| 2,715,668 | 8/1955 | Booker et al. | 219/543 X |
| 2,719,907 | 10/1955 | Combs | 219/528 |
| 2,732,479 | 1/1956 | Rowland | 219/549 X |
| 2,782,289 | 2/1957 | Nathanson | 219/528 X |
| 2,868,946 | 1/1959 | Stephenson | 219/545 |
| 2,976,387 | 3/1961 | Browne | 219/528 |
| 2,989,613 | 6/1961 | Morey | 219/528 |
| 3,153,140 | 10/1964 | Theodore et al. | 219/549 |
| 3,168,617 | 2/1965 | Richter | 219/549 X |
| 3,239,403 | 3/1966 | Williams et al. | 156/275 |
| 3,248,682 | 4/1966 | Curtis | 338/300 |
| 3,277,419 | 10/1966 | Butz | 338/314 |
| 3,378,673 | 4/1968 | Hopper | 219/301 |
| 3,385,959 | 5/1968 | Ames et al. | 219/549 |
| 3,417,229 | 12/1968 | Shomphe et al. | 219/528 |
| 3,457,537 | 7/1969 | Hines | 338/162 |
| 3,514,581 | 5/1970 | Rocholl et al. | 219/522 |
| 3,636,311 | 1/1972 | Stager | 219/522 |
| 3,683,361 | 8/1972 | Salzwedel | 338/322 |
| 3,736,404 | 5/1973 | Eisler | 219/203 |
| 3,749,886 | 7/1973 | Michaelsen | 219/528 |
| 3,757,087 | 9/1973 | Bernard | 219/549 |
| 3,798,419 | 3/1974 | Maake | 219/541 |
| 3,861,029 | 1/1975 | Smith-Johannsen et al. | 29/611 |
| 3,878,362 | 4/1975 | Stinger | 219/528 |
| 4,055,526 | 10/1977 | Kiyokawa et al. | 264/22 |
| 4,058,704 | 11/1977 | Shimizu | 219/528 |
| 4,072,848 | 2/1978 | Johnson et al. | 219/528 |
| 4,156,127 | 5/1979 | Sako et al. | 219/301 |
| 4,173,823 | 11/1979 | Anderson et al. | 29/611 |
| 4,200,973 | 5/1980 | Farkas | 29/611 |
| 4,203,198 | 5/1980 | Hackett et al. | 29/611 |
| 4,220,848 | 9/1980 | McMullan et al. | 219/528 |
| 4,370,548 | 1/1983 | Nagasawa et al. | 219/549 |

FOREIGN PATENT DOCUMENTS

| | | |
|---|---|---|
| 8202667 | 7/1982 | Sweden . |
| 491576 | 7/1970 | Switzerland . |

*Primary Examiner*—Volodymyr Y. Mayewsky

[57] ABSTRACT

The heater of the present invention includes a paper or plastic substrate on which is printed a semi-conductor pattern (typically a colloidal graphite ink) having (a) a pair of longitudinal stripes extending parallel to and spaced apart from each other and (b) a plurality of identical bars spaced apart from each other and extending between and electrically connected to the stripes. A metallic conductor (typically copper stripping) overlies each of the longitudinal stripes in face-to-face engagement therewith, and the conductors are held in tight engagement with the stripes by a sealing layer that overlies the metallic conductors and is sealed, at opposite sides of the semi-conductor stripe associated with the particular metallic conductor, to portions of the substrate that are free from the printed semi-conductor pattern.

34 Claims, 13 Drawing Figures

FIG 4A
130 watts/m
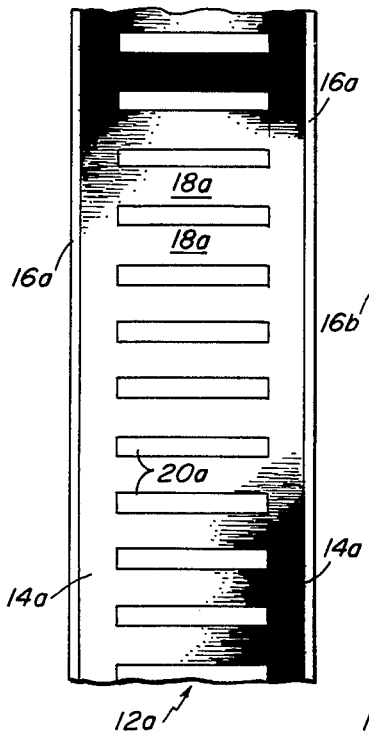
FIG 4B
65 watts/m
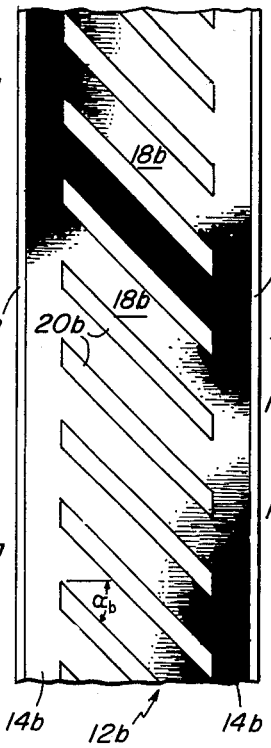
FIG 4C
32.5 watts/m
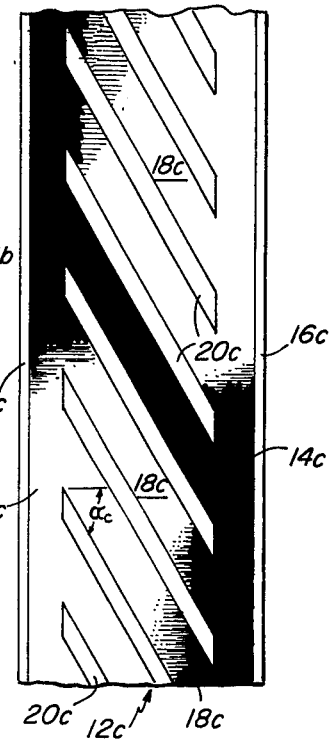
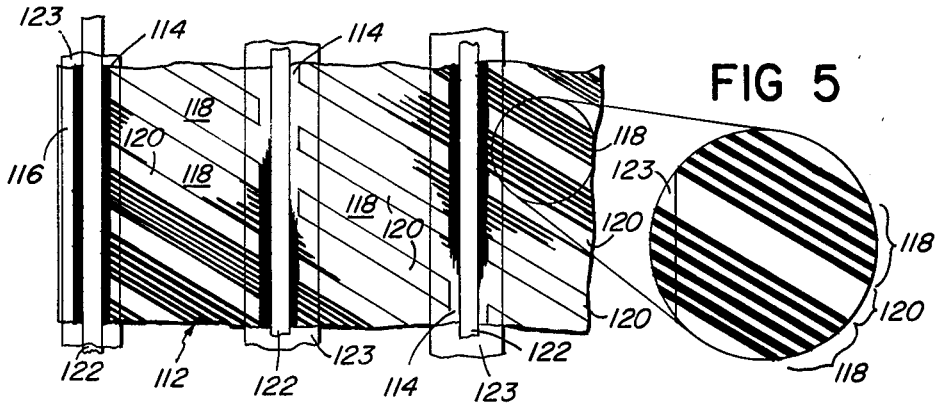
FIG 5
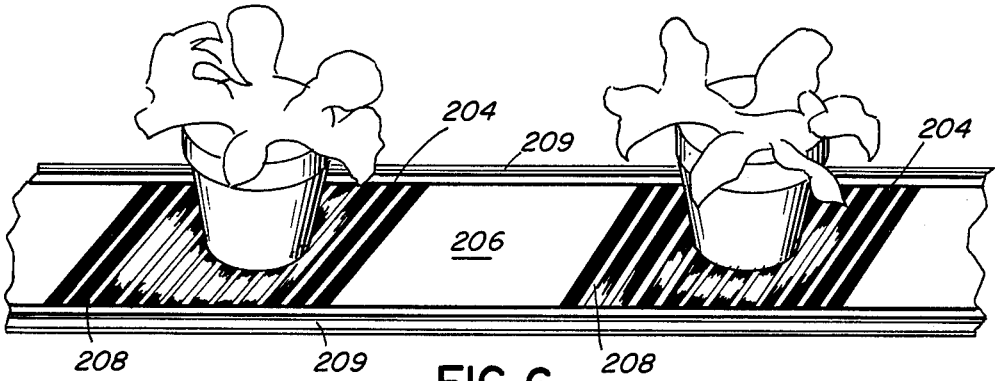
FIG 6

ELECTRICAL RESISTANCE HEATER

CROSS-REFERENCE TO RELATED APPLICATIONS

This application is a continuation-in-part of, and claims priority from, U.S. patent application Ser. No. 181,974 filed Aug. 28, 1980 and now abandoned.

BACKGROUND OF THE INVENTION

Many electric heating tapes have been made in the past, most include thin-wire or etched foil heaters and are specifically designed to produce a specific wattage over a predetermined length. Such tapes are generally fairly expensive; it is difficult to vary their watt density; and many cannot be used in wet or damp environments.

SUMMARY OF THE INVENTION

The present invention provides a flexible continuous sheet heater having a high uniformity in heat propogation that can replace existing thin-wire and etched foil heaters at a fraction of the cost of the existing devices. It is relatively inexpensive to produce, can be used in a wet or damp environment, has a constant watt density per unit length, and is so designed that the watt density can be varied within wide limits.

In general, the heater of the present invention includes a paper or plastic substrate on which is printed a semi-conductor pattern (typically a colloidal graphite ink) having (a) a pair of longitudinal stripes extending parallel to and spaced apart from each other and (b) a plurality of identical bars spaced apart from each other and extending between and electrically connected to the stripes. A metallic conductor (typically copper stripping) overlies each of the longitudinal stripes in face-to-face engagement therewith, and the conductors are held in tight engagement with the stripes by a sealing layer that overlies the metallic conductors and is bonded, at opposite sides of the semi-conductor stripe associated with the particular metallic conductor, to portions of the substrate that are free from the printed semiconductor pattern.

In many preferred embodiments, the substrate, semiconductor pattern and metallic conductors are hermetically sealed between a pair of plastic sheets. One sheet is positioned on each side of the substrate and the edges of the sheets extend beyond the sides of the substrate and are heat sealed together.

The wattage per unit length (watt density) of the heater is uniform regardless of the overall length of the heater, and any desired length can be cut off a reel and used as desired. Further, without changing either the semi-conductor material, or the thickness or width of the printed bars of the semi-conductor pattern, the watt density of the heater may be varied widely simply by changing the angle between the longitudinal stripes and the bars.

The heater of the instant invention can be made in either sheet (of any desired length and width) or tubular form. Typical uses include area (e.g., wall or floor) heaters, pizza box heaters, thin heaters for pipes, wide heaters for under desks and tables, spaced heaters for greenhouse plant use, and cylindrical hose-shaped heaters.

BRIEF DESCRIPTION OF THE DRAWINGS

FIGS. 4A, 4B and 4C are simplified views illustrating changes in watt density.

FIG. 5 is a plan view of a modification of the heater of FIG. 1.

FIG. 6 is a perspective view of a second modification of the heater of FIG. 1.

DETAILED DESCRIPTION OF PREFERRED EMBODIMENTS

Figure 1:
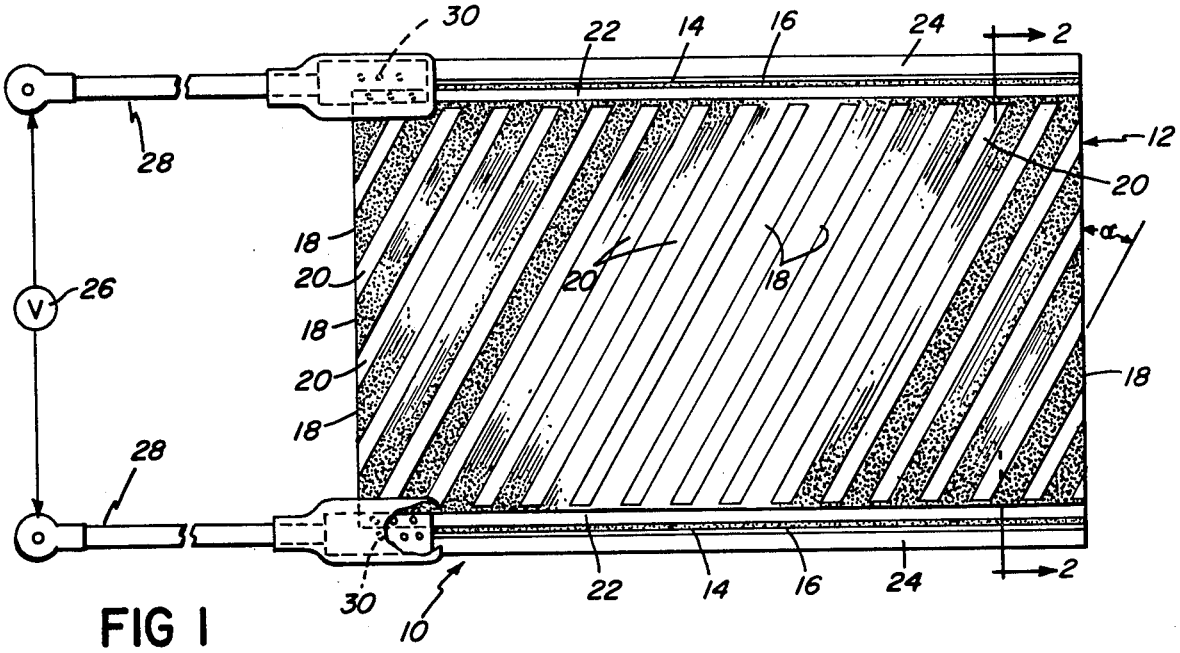
FIG. 1 is a plan view of a heater embodying the present invention with the top layer removed for clarity.
Figure 2:
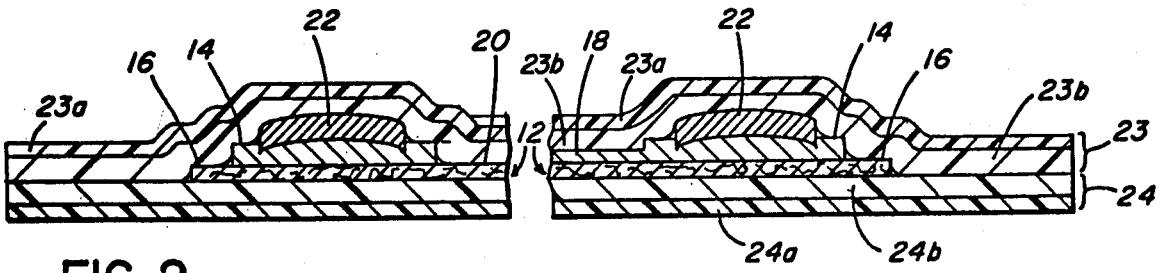
FIG. 2 is a section taken of 2—2 of FIG. 1.
Figure 3:
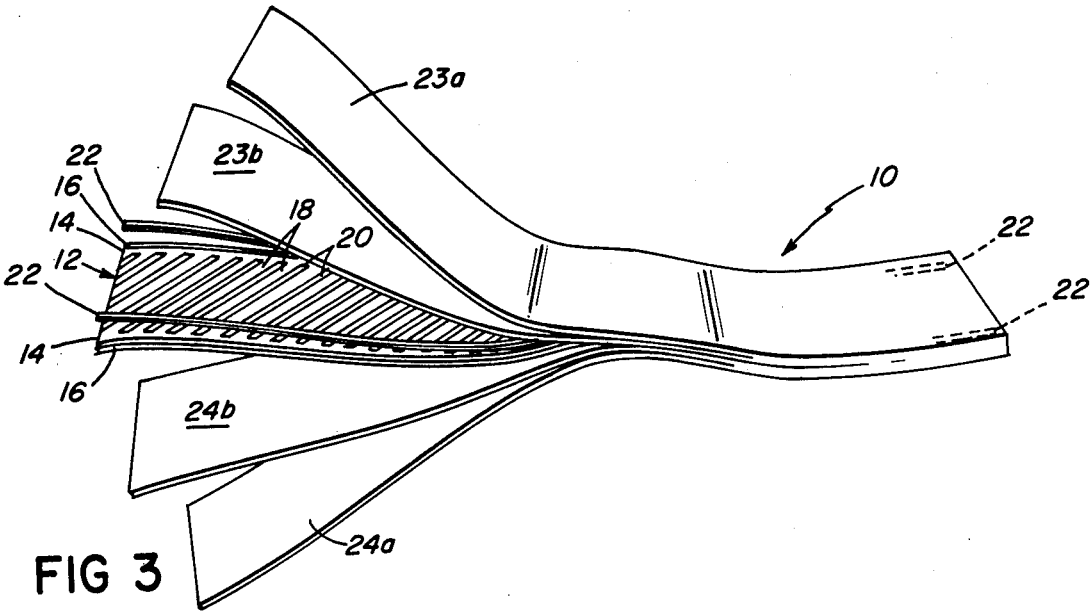
FIG. 3 is a partially exploded view of the heater of FIG. 1.

Referring now to FIGS. 1–3, there is shown a length of an electrical heater generally designated 10, comprising a paper substrate 12 on which is printed, typically by silk-screening, a semi-conductive pattern of colloidal graphite. The graphite pattern includes a pair of parallel longitudinal stripes 14. Each stripe is 0.397 cm. (5/32 in.) wide and the inner edges of the stripes are 8.73 cm. (3 7/16 in.) apart. The overall width of the graphite pattern, thus, is 9.525 cm. (3¾ in.); and the substrate 12 on which the pattern is centered is of sufficient width (normally about 10 cm. or 4 in.) to leave a 0.08 cm. (1/32 in.) to about 0.64 cm. (¼ in.) uncoated boundary 16 along each edge.

The graphite pattern includes also a plurality of identical regularly-spaced semi-conductor bars 18 extending between stripes 14. Each bar 18 is 0.64 cm. (¼ in.) wide (measured perpendicular to its edges) and the space 20 between adjacent bars (i.e., the unprinted area or "white" space) is 0.32 cm. (⅛ in.) wide. As shown, all of bars 18 extend in straight lines and form an angle, designated $\alpha$, of 30° with a line extending perpendicularly between stripes 14. Since bars 18 are twice as wide as the spaces 20 between them, 66⅔ per cent of the area between stripes 14 is coated with semi-conductor material.

In this and other preferred embodiments, the material forming the semi-conductor patterns of stripes 14 and bars 18 is a conductive graphite ink (i.e., a mixture of conductive colloidal graphite particles in a binder) and is printed on the paper substrate 12 at a substantially uniform thickness (typically about 0.0025 cm. or 0.001 in. for the portion of the pattern forming bars 18 and about 0.0035 cm. or 0.0014 in. for the portions of the pattern forming stripes 14) using a conventional silk-screen process. Inks of the general type used are commercially available from, e.g., Acheson Colloidals of Port Huron, Michigan (Graphite Resistors for Silk Screening) and DuPont Electronic Materials, Photo Products Department, Wilmington, Delaware (4200 Series Polymer Resistors, Carbon and Graphite Base). A similar product, Polymer Resistent Thick Films, is sold by Methode Development Co. of Chicago, Illinois.

Semi-conductor materials of the type used in the present invention are also discussed in the literature, see for example U.S. Pat. Nos. 2,282,832; 2,473,183; 2,559,077; and 3,239,403. The literature teaches that such materials may be made by mixing conductive particles other than graphite, e.g., carbon black or equally finely divided metals or metallic carbides, in a binder; and that the specific resistance of the particle:binder mixture may be varied by changing the amount and kind of electrically conductive particles used. It teaches also that the mixture may be sprayed or brushed onto a variety of different substrate materials.

A copper electrode 22, typically 0.32 cm. (⅛ in.) wide and 0.005 cm. (0.002 in.) thick, is placed on top of each longitudinal stripe 14. Electrodes 22 are slit from thin copper sheets and, as a result, are slightly curved and have sharp "points" at either side. The electrodes are mounted on stripes 14 with their convex surfaces facing up and the "points" along the edges facing down into and engaging stripes 14. This is most clearly shown in FIG. 2, in which the amount of curvature and size of the "points" of the electrodes is exaggerated for clarity. For long heaters, it is often desirable to increase the thickness of electrodes 22 to 0.01 cm. (0.004 in.) or so to increase their current carrying capacity.

It will be noted that stripes 14 are wider than either bars 18 or the spaces 20 between adjacent bars. This, coupled with the greater thickness of the stripes relative to the bar (e.g., a stripe thickness of about 1.4 times the bar thickness), reduces the interface resistance from the copper electrodes 22 to the bars 18.

Substrate 12, the graphite pattern (stripes 14 and bars 18) printed thereon and electrodes 22 are hermetically sealed between a pair of thin plastic sheets 23, 24. Each of sheets 23, 24 is a co-lamination of a 0.005 cm. (0.002 in.) thick polyester ("Mylar") dielectric insulator **23*a*, 24*a* and a 0.007 cm. (0.003 in.) thick adhesive binder, 23*b*, 24*b*, typically polythylene. Plastic adheres poorly to graphite, but the polyethylene sheets 23*b*, 24*b* bond well to substrate 12 and to each other. In particular, the polyethylene sheet 23*b* on top of substrate 12 is bonded both to the uncoated paper boundry 16 outside stripes 14 and, on the inside of electrodes 22, to the uncoated paper spaces 20 between adjacent bars 18. Sheet 23*b* thus holds the electrodes 22 tightly in place against stripes 14. The electrode-to-graphite engagement is further enhanced by shrinkage of plastic sheets 23, 24 during cooling after lamination. Sheets 23, 24 are 0.64 cm. (¼ in.) wider than substrate 12 and are sealed to each other outside the longitudinal edges of substrate 12, providing the desired hermetric seal. It will be noted that stripes 14 are slightly wider than electrodes 22. This extra width is desirable because of manufacturing tolerences to insure that the electrode always fully engages an underlying stripe. However, the extra width should be kept to a minimum to insure that the distance between the uncoated substrate boundary 16 and spaces to which the plastic sheet 23** overlying the electrodes is bonded is as short as possible.

Electric leads 28 connect heater 10 to a source of power 26. As shown, each lead 28 includes a crimp-on connector 30 having pins which pierce the plastic sheets 23, 24 and engage one of electrodes 22.

The resistance of silk-screened semi-conductor pattern (typically over 1000 ohms/square) is much greater than that of the copper electrodes 22 (typically less than 0.001 ohms per square); and it will thus be seen that the watt density (i.e., the wattage per linear foot of heater 10 depends primarily on the length, width and number of bars 18. Mathematically, the watt density (WD), i.e. W/UL, or watts per unit length (e.g., meter, foot, etc.), can be expressed as:

$$WD = V^2 n / NbR$$

where V is the potential difference in volts between the two copper electrodes, n is the number of bars 18 per unit length of tape, N is the inverse of the width of a bar 18, b is the center line length of a bar 18, and R is the resistance of the portion of the printed semi-conductor (e.g., graphite) pattern forming bars 18 in ohms per square.

The spaces 20 between the bars 18 of the semiconductor pattern provide at least three functions: they provide graphite-free areas at which the plastic sheet 23 or other sealing layer holding electrodes 22 in engagement with stripes 14 may be bonded to the substrate 12; they permit the bars 12 to be oriented at any desired angle relative to the electrodes 22 and stripes 14; and, since a length of stripe 14 equal to the sum of (i) the width of a bar 18 plus (ii) the width of a space 20 is provided at each end of each bar, they increase the electrode-to-semi-conductor contact area for the bars.

Referring now to FIGS. 4A–4C, there are illustrated three substrates **12*a*, 12*b*, 12*c*, each carrying a respective graphite semi-conductor pattern, designated 11*a*, 11*b*, 11*c*, respectively. The stripes 14*a*, 14*b*, 14*c*, and the bars 18*a*, 18*b*, 18*c* of each pattern are, respectively of the same width and thickness; and the spaces 20*a*, 20*b*, 20*c* between adjacent bars and the distances between stripes 14 are the same also. The only difference between the three substrates is the angle, $\alpha$, at which the bars 18 are oriented relative to the stripes 14, or more particularly to a line extending perpendicularly between the stripes. On substrate 12*a*, the bars are perpendicular to the stripes (i.e., $\alpha=0°$); on substrate 12*b*, the angle $\alpha_b$ is equal to 45°; and the angle $\alpha_c$ on substrate 12*c* is equal to 60°. On each of the three substrates, the portion of the graphite semi-conductor pattern forming the bars 18 is printed on the substrate at a resistance of 2875 ohms per square; the two stripes 14 are 2.54 cm. (1 inch apart); and, as with the substrate 12 of heater 10, each bar 18*a*, 18*b*, 18*c* is 0.64 cm. (¼ in.) wide, and the space between adjacent bars 18** is 0.32 cm. (⅛ in.) wide.

Using the formula provided above, it will be seen that a heater using substrate **12*a* will have a watt density of 130 watts per meter (40 watts per linear foot); while the watt densities of heaters using substrates 12*b* and 12*c* will be, respectively, 65 and 32.5 watts per meter (20 and 10 watts per linear foot). In each instance, it will of course be recognized that this is the watt density for the portion of the heater in which the bars 18 extend between and are electrically connected to the stripes 14**, and does not include the short distance at each end of a heater in which, if the bars are not perpendicular to the stripes, there are a few bars that are not so connected.

FIG. 5 shows a modified heater 110 in which the graphite semiconductor pattern is printed on a polyethylene substrate 112 and includes more than two (as shown over 4) longitudinal stripes 114 each underlying and engaging an electrode 122. A set of bars 118 extends between each pair of stripes 114, and as before each bar 118 is wider than the open (no graphite space 120 between adjacent bars 118. All of the bars 118 are at an angle of 45° to stripes 114; and, as before, the bars 118 are printed on ⅔ of the substrate area between stripes 114, leaving ⅓ of the space for bonding. In the FIG. 5 embodiment, however, bars 118 are not solid. Rather, each bar comprises six thin (0.04 cm. or about 0.015 in.) parallel graphite lines spaced 0.08 cm. (about 0.030 in.)

apart. The overall width of each bar 118 is about 0.64 cm. (¼ in.) and the spaces 120 between bars 118 are 0.32 cm. (⅛ in.) wide. The distance between the thin lines forming each bar 118 is such that the heat radiates into the void between adjacent lines.

The multi-line bar design of the FIG. 5 embodiment is especially useful when the resistivity of the semi-conductor graphite material is such that a solid bar would be more conductive than desired. The multi-stripe and electrode design of the FIG. 5 embodiment is used when the overall width of the heater is such that a continuous bar 118 extending substantially the full width of the heater would have a greater resistance than desired.

In the FIG. 5 embodiment, each of electrodes 122 is held in place by a discrete relatively narrow piece of plastic 123 (e.g., polyethylene) that overlies the particular electrode 120 and is sealed to the plastic substrate 112 at the spaces 120 (or in the case of the electrodes at the edge of the heater to the spaces 120 and boundary 116) on either side of the stripe 114 underlying the particular electrode. As will be seen, the FIG. 5 design greatly reduces the amount of plastic required, and thus reduces the cost of the heater; but the lack of a complete hermetric seal can limit the environments in which the heater can be used. In other embodiments, the electrodes may be held in tight engagement with the substrate by, e.g., thermoset resins, elastomers, or other laminating materials. The amount of plastic required can be further reduced by using a paper rather than a plastic substrate.

The heater 202 shown in FIG. 6, in which the graphite pattern includes areas 204 about 15 cm. (6 in.) long which include bars 206 interrupted by spaces 208 of equal length on which no bars are printed, is especally suited for greenhouses. A pot containing seeds or seedlings may be placed on each space 204, but no power will be wasted heating the spaces 208 between pots. As will be seen, the bars 206 in the FIG. 6 embodiment are printed so that all the bars in each area 204 extend between and are electrically connected to stripes 209.

Figure 7:
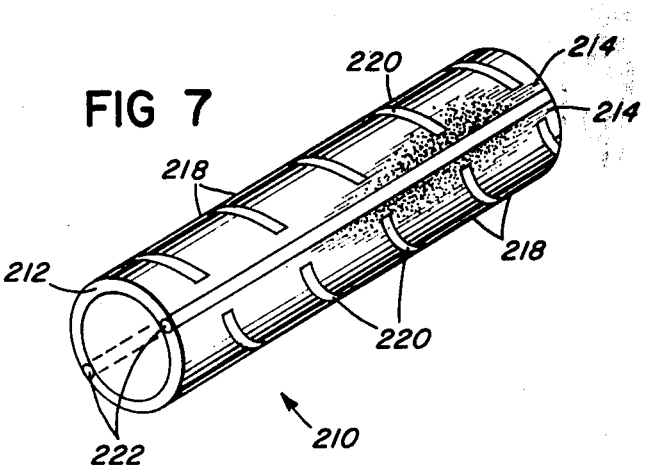
FIG. 7 is a perspective view of a second heater including the invention.

FIG. 7 illustrates a tubular member 210 having a plastic base 212 in which is embedded (or, alternatively, are placed thereon) a pair of elongated parallel electrodes 222 at 180° with respect to each other. The colloidal graphite pattern is printed on base 212 with bars 218 extending helically between longitudinal stripes 214 along each edge of electrodes 222.

Figure 8:
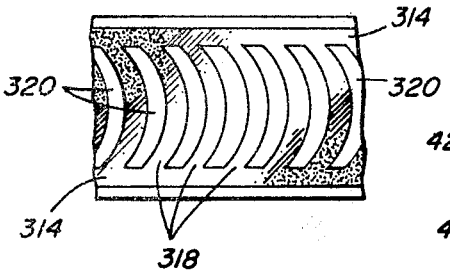
FIGS. 8–11 are diagramatic views illustrating alternative forms of semi-conductor patterns for heaters embodying the invention.
Figure 9:
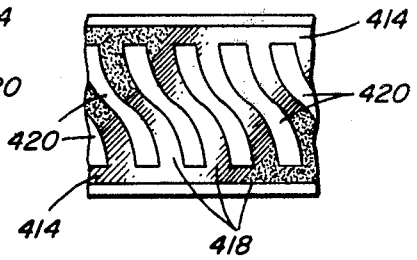
Figure 10:
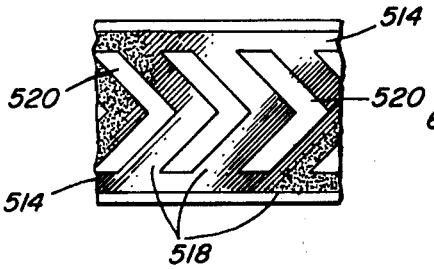
Figure 11:
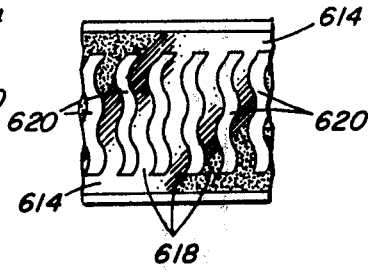

Referring now to FIGS. 8–11 there are shown other graphite patterns that may be used with the heaters of FIGS. 1, 5 and 7. Each pattern includes a pair of parallel longitudinally-extending stripes, 314, 414, 514, 614, and a plurality of identical bars 318, 418, 518, 618 extending therebetween. In each instance, the bars are at least as wide as the spaces 320, 420, 520, 620 between adjacent bars and are narrower than stripes 314, 414, 514, 614; and each bar is longer than the perpendicular distance between the two stripes it connects. In FIG. 8, the bars 318 are smooth arcs; the bars 418 in FIG. 9 are S-shaped or reverse curves; the FIG. 10 heater has bars 518 in the shape of chevrons; and the bars 618 of the FIG. 11 heaters are curved with multiple points of inflection. In each design, typically, the stripes are thicker than the bars.

We claim:

1. An electrical heating device comprising:

a substrate having an electrically insulating surface a semi-conductor pattern carried on said electrically insulating surface of said substrate, said pattern including a pair of stripes extending longitudinally of said device generally parallel to and spaced apart from each other, and a plurality of bars spaced apart from each other and extending between and electrically connected to said stripes, all of said plurality of bars being identical to each other and being identically oriented relative to said stripes and said bars and stripes being arranged so as to provide portions of said substrate intermediate said stripes and adjacent ones of said bars and closely adjacent to and spaced along the longitudinally-extending edges of said stripes that are free from said semi-conductor pattern;

a pair of elongated conductors, each of said conductors having a resistivity less than that of said bars and said strips and overlying and in direct electrical engagement with one of said pair of stripes; and an electrically insulating sealing sheet overlying at least one of said conductors and the said one of said pair of stripes associated therewith, said sheet being sealed at one side of said one conductor to said portions of said substrate closely adjacent said one conductor that are free from said semi-conductor pattern and at the opposite side of said one conductor to portions of said substrate closely adjacent the other longitudinal edge of said one conductor that are free from said semi-conductor pattern, whereby said sealing sheet holds said one conductor in tight face-to-face engagement with said one stripe.

2. The electrical heating device of claim 1 wherein said sealing sheet extends from adjacent said other longitudinal edge of one of said strips to the far side of the other of said stripes and is sealed to portions of said substrate intermediate adjacent ones of said bars, and adjacent the far sides of the other of said stripes.

3. The electrical heating device of claim 1 wherein said bars extend between said stripes in straight lines portions oblique to said stripes.

4. The electrical heating device of claim 1 wherein each of said conductors is a metallic strip slightly curved transverse cross-section and positioned with the convex surface thereof facing away from said substrate.

5. The heating device of claim 1 wherein each of said bar portions comprises a straight line extending from one of said stripes toward the other of said stripes and forming a predetermined oblique angle with a line extending perpendicularly between said stripes.

6. The electrical heating device of claim 1 wherein said pattern includes a third said stripe spaced from and parallel to said pair of stripes and a plurality of further bars spaced apart from each other and extending from said third stripe to one of said pair of first stripes, and comprising also a said conductor overlying and engaging said third stripe.

7. The electrical heating device of claim 6 wherein said further bars are substantially identical to said first-mentioned bars and are oriented relative to said third stripe identically to the orientation of said first-mentioned bars relative to one of said pair of stripes.

8. The electrical heating device of claim 1 wherein the resistivity of said conductors is at least an order of magnitude less than that of said bars.

9. The electrical heating device of claim 1 wherein said bars are of substantially uniform thickness, said stripes are of substantially uniform thickness, and the thickness of said stripes is greater than that of said bars.

10. The electrical heating device of claim 1 wherein said semi-conductor pattern comprises colloidal graphite and a binder.

11. The heating device of claim 1 wherein each of said bars comprises two straight line portions each of which is oblique to one of said conductors and which form an obtuse angle with each other.

12. The heating device of claim 1 wherein said substrate is paper.

13. The heating device of claim 1 wherein said substrate is organic plastic.

14. The heating device of claim 1 wherein each of said bars comprises a plurality of parallel spaced thin lines of semi-conductor material, the distance between adjacent ones of said lines of a said bar being less than half the distance between adjacent ones of said bars.

15. The heating device of claim 14 wherein the distance between each of said lines of a said bar is greater than the width of the lines of said bar.

16. The heating device of claim 1 wherein the width of each of said bars is about twice the width of the space between adjacent ones of said bars.

17. The heating device of claim 1 wherein said pattern is printed on said substrate such that the resistivity of the portion of said pattern defining said bars is not less than about 1000 ohms per square.

18. The heating device of claim 1 wherein said sealing is water-impervious and including a second sheet of water-impervious material on the side of said conductors and semi-conductor pattern opposite said sealing sheet, each of said sheets extending transversely of said device from beyond the outer edge of one of said conductors to beyond the outer edge of the other of said conductors, and said sheets being sealed together along respective lines extending longitudinally of said device adjacent the outer edges of said conductors.

19. The heating device of claim 18 wherein said conductors, substrate and semi-conductor pattern are between said sealing sheet and said second sheet and said sheets extend beyond the side edges of said substrate.

20. The heating device of claim 18 wherein each of said sealing sheet and said second sheet is a sheet of organic plastic.

21. The heating device of claim 1 wherein said sealing sheet comprises an organic plastic sheet overlying said substrate and attached to portions of said substrate closely adjacent said conductors and not covered by said semi-conductor pattern or said conductors.

22. The electrical heating device of claim 1 wherein said sealing sheet is a sheet of organic plastic material and is sealed at the side of said one conductor opposite the other of said conductors to a second sheet of organic plastic material, said second sheet of organic plastic material being on the side of said semi-conductor pattern opposite said first-mentioned sheet.

23. The electrical heating device of claim 1 wherein the length of the junctions between the ends of said bars and the longitudinally-extending edges of said stripes, measured parallel to said stripes, is in the range of not more than ½ inch.

24. The electrical heating device of claim 23 wherein said range is ¼ inch to ½ inch.

25. The electrical heating device of claim 1 wherein the length of the junctions between the ends of the spaces between adjacent one of said bars and the longitudinally-extending edges of said stripes, measured parallel to said stripes, is in the range of not less than ⅛ inch.

26. The electrical heating device of claim 25 wherein said range is ⅛ to ¼ inch.

27. The electrical heating device of claim 1 wherein about two thirds of the area bounded by said stripes and the most longitudinally spaced of said bars is coated with said semi-conductor material.

28. An electrical heating device comprising:

a substrate having an electrically-insulating surface a semi-conductor pattern carried on said surface of said substrate, said pattern including a pair of generally continuous pattern portions extending longitudinally of said device and generally parallel to and spaced apart from each other, and other pattern portion between and electrically connected to said continuous pattern portions, said other pattern portion being arranged so as to provide portions of said substrate intermediate said continuous pattern portions and closely adjacent to and spaced along the adjacent longitudinally-extending edges of said continuous pattern portions that are free from said semi-conductor pattern;

a pair of elongated conductors, each of said conductors having a resistivity less than that of said continuous pattern portions and overlying and in direct electrical engagement with one of said pair of said continuous pattern portions; and an electrically-insulating sealing sheet overlying at least one of said conductors and the one of said pair of continuous pattern portions associated therewith, said sheet being sealed at one side of said one conductor to said portions of said substrate intermediate said continuous pattern portions that are free from said semi-conductor pattern, whereby said sheet holds said one conductor in tight face-to-face engagement with the associated one of said continuous pattern portions.

29. The electrical heating device of claim 28 wherein portions of said substrate closely adjacent the side of each of said continuous pattern portions opposite the other of said continuous pattern portions are free from said semi-conductor pattern, and said sealing sheet is sealed at opposite sides of said one conductor to portions of said substrate that are closely adjacent said opposite sides of said one conductor and free from said semi-conductor pattern.

30. The electrical heating device of claim 28 wherein the distance between adjacent ones of said portions that are free from said semi-conductor pattern, measured longitudinally of said device, is in the range of not more than ½ inch.

31. The electrical heating device of claim 30 wherein said range is ¼ to ½ inch.

32. The electrical heating device of claim 28 wherein the length of the junctions between said portions that are free from said semi-conductor pattern and the longitudinally-extending edges of said continuous pattern portions, measured longitudinally of said device, is in the range of not less than ⅛ inch.

33. The electrical heating device of claim 32 wherein said range is ⅛ inch to ¼ inch.

34. An electrical heating device comprising: a substrate having an electrically insulating surface;

a semi-conductor pattern carried on said electrically insulating surface of said substrate, said pattern including a plurality of substantially identical and identically oriented bars spaced apart from each other and extending generally transversely of said substrate between and electrically connected to said stripes and, at each end of each of said bars, a semi-conductor portion abutting said bar and extending longitudinally of said device beyond at least one of the side edges of said bar such that the length of such longitudinally-extending portion is greater than the width of the said bar with which it is associated;

a pair of elongated conductors, each of said conductors having a resistivity less than that of said bars and said longitudinally-extending semi-conductor portions and overlying and in direct electrical engagement with the said longitudinally-extending semi-conductor portion at one end of each of said bars; and an electrically insulating sealing sheet overlying at least one of said conductors and the said longitudinally-extending semi-conductor portions associated therewith, said semi-conductor pattern being arranged so as to provide portions of said substrate intermediate adjacent ones of said bars and closely adjacent to and spaced along the longitudinally-extending edges of said one conductor that are free from said semi-conductor pattern, and said sheet being sealed at one side of said one conductor to portions of said substrate closely adjacent said one conductor that are free from said semi-conductor pattern and at the opposite side of said one conductor to portions of said substrate closely adjacent the other longitudinal edge of said one conductor that are free from said semi-conductor pattern, whereby said sealing sheet holds said one conductor in tight face-to-face engagement with said longitudinally-extending semi-conductor portions underlying said one conductor.

* * * * *